US009914893B2

(12) United States Patent
Kashani-Shirazi et al.

(10) Patent No.: US 9,914,893 B2
(45) Date of Patent: Mar. 13, 2018

(54) USE OF ALKOXYLATED POLYETHYLENE GLYCOLS IN LUBRICATING OIL COMPOSITIONS

(71) Applicant: BASF SE, Ludwigshafen (DE)

(72) Inventors: Nawid Kashani-Shirazi, Mannheim (DE); Muriel Ecormier, Mannheim (DE); Thomas Weiss, Ilvesheim (DE)

(73) Assignee: BASF SE (DE)

( * ) Notice: Subject to any disclaimer, the term of this patent is extended or adjusted under 35 U.S.C. 154(b) by 0 days.

(21) Appl. No.: 15/114,910

(22) PCT Filed: Jan. 19, 2015

(86) PCT No.: PCT/EP2015/050890
§ 371 (c)(1),
(2) Date: Jul. 28, 2016

(87) PCT Pub. No.: WO2015/113850
PCT Pub. Date: Aug. 6, 2015

(65) Prior Publication Data

US 2016/0348024 A1 Dec. 1, 2016

(30) Foreign Application Priority Data

Jan. 28, 2014 (EP) ..... 14152862

(51) Int. Cl.
*C10M 107/34* (2006.01)
*C10N 20/02* (2006.01)

(52) U.S. Cl.
CPC .. *C10M 107/34* (2013.01); *C10M 2203/1025* (2013.01); *C10M 2205/0285* (2013.01); *C10M 2209/1045* (2013.01); *C10M 2209/1055* (2013.01); *C10M 2209/1065* (2013.01); *C10M 2209/1075* (2013.01); *C10N 2020/02* (2013.01); *C10N 2230/06* (2013.01); *C10N 2240/02* (2013.01); *C10N 2240/04* (2013.01); *C10N 2240/046* (2013.01)

(58) Field of Classification Search
CPC ..... C10M 107/34; C10M 2209/1045; C10N 2020/02; C10N 2230/06
See application file for complete search history.

(56) References Cited

U.S. PATENT DOCUMENTS

| | | | | |
|---|---|---|---|---|
| 3,087,936 | A | 4/1963 | Le Suer | |
| 3,149,178 | A | 9/1964 | Hamilton et al. | |
| 3,172,892 | A | 3/1965 | Le Suer et al. | |
| 3,254,025 | A | 5/1966 | Le Suer | |
| 3,381,022 | A | 4/1968 | Le Suer | |
| 3,382,291 | A | 5/1968 | Brennan | |
| 3,742,082 | A | 6/1973 | Brennan | |
| 3,769,363 | A | 10/1973 | Brennan | |
| 3,876,720 | A | 4/1975 | Heilman et al. | |
| 4,149,178 | A | 4/1979 | Estes | |
| 4,234,435 | A | 11/1980 | Meinhardt et al. | |
| 4,239,930 | A | 12/1980 | Allphin et al. | |
| 4,367,352 | A | 1/1983 | Watts, Jr. et al. | |
| 4,413,156 | A | 11/1983 | Watts, Jr. et al. | |
| 4,434,308 | A | 2/1984 | Larkin | |
| 4,434,408 | A | 2/1984 | Baba et al. | |
| 4,910,355 | A | 3/1990 | Shubkin et al. | |
| 4,956,122 | A | 9/1990 | Watts et al. | |
| 5,068,487 | A | 11/1991 | Theriot | |
| 5,135,638 | A | 8/1992 | Miller | |
| 5,246,566 | A | 9/1993 | Miller | |
| 5,362,378 | A | 11/1994 | Borghard et al. | |
| 5,565,086 | A | 10/1996 | Cody et al. | |
| 5,736,174 | A * | 4/1998 | Cooper | A23D 9/007 426/531 |
| 6,303,533 | B1 | 10/2001 | Grosch et al. | |
| 2009/0088349 | A1* | 4/2009 | Zhao | C10M 105/18 508/185 |

FOREIGN PATENT DOCUMENTS

| | | | |
|---|---|---|---|
| EP | 0 090 444 | A2 | 10/1983 |
| EP | 0141473 | A1 | 5/1985 |
| EP | 321302 | A2 | 6/1989 |
| EP | 321304 | A2 | 6/1989 |
| EP | 710710 | A2 | 5/1996 |
| EP | 0 862 947 | A1 | 9/1998 |
| WO | WO-8400361 | A1 | 2/1984 |
| WO | WO-8500182 | A1 | 1/1985 |
| WO | WO-2008/014315 | A2 | 1/2008 |

OTHER PUBLICATIONS

U.S. Appl. No. 15/039,594, filed May 26, 2016, Rettemeyer et al.
International Search Report for PCT/EP2015/050890 dated Apr. 16, 2015.
Nabar, Y., "Dow UCON™ Oil Soluble Polyalkylene Glycols a New Type of Group V Base Oil Content", 8th International Symposium on Fuels and Lubricants, New Delhi, Mar. 2012, p. 8.

* cited by examiner

*Primary Examiner* — Taiwo Oladapo
(74) *Attorney, Agent, or Firm* — Drinker Biddle & Reath LLP

(57) ABSTRACT

The presently claimed invention is directed to the use of polyethylene glycols that are prepared by alkoxylating polyethylene glycol with at least one $C_8$-$C_{30}$ epoxy alkane in lubricating oil compositions.

28 Claims, No Drawings

USE OF ALKOXYLATED POLYETHYLENE GLYCOLS IN LUBRICATING OIL COMPOSITIONS

CROSS-REFERENCE TO RELATED APPLICATIONS

This application is a national stage application (under 35 U.S.C. § 371) of PCT/EP2015/050890, filed Jan. 19, 2015, which claims benefit of European Application No. 14152862.0, filed Jan. 28, 2014, both of which are incorporated herein by reference in their entirety.

The presently claimed invention is directed to the use of alkoxylated polyethylene glycols that are prepared by alkoxylating polyethylene glycol with at least one $C_8$-$C_{30}$ epoxy alkane in lubricating oil compositions.

Lubricating oil compositions are used in a variety of applications, such as industrial applications, transportation and engines. Industrial applications comprise of applications such as hydraulic oil, air compressor oil, gas compressor oil, gear oil, bearing and circulating system oil, refrigerator compressor oil and steam and gas turbine oils.

Conventional lubricating oil compositions comprise base stocks, co-solvents and additives. The base stock is in each case selected according to the viscosity that is desired in the envisioned application. Combinations of base stocks of different viscosities, i.e. low and high viscosity respectively, are often used to adjust the needed final viscosity. The co-solvents are used to dissolve polar additives in usually less polar or unpolar base stocks.

The most common additives are antioxidants, detergents, anti-wear additives, metal deactivator, corrosion inhibitors, friction modifiers, extreme-pressure additives, defoamers, anti-foaming agents, viscosity index improvers and demulsifying agents. These additives are used to impart further advantageous properties to the lubricating oil composition including longer stability and additional protection.

However, after a certain operation time, lubricating oil compositions have to be replaced for various reasons such as lubricity loss and/or product degradation. Depending on the machine (engine, gearbox, compressor . . . ) engineering design and the affinity of the lubricant components to adhere to the surface, a certain residue of the lubricating oil composition (hold-up) remains in the machine, engine, gear etc. it is used in. When being replaced by an unused and possibly different lubricating oil composition, the used and new lubricants are mixed with each other. Thus, in order to avoid any complications during operation, compatibility between the old and new lubricant is very important.

Depending on their chemical properties a variety of components of lubricating oil compositions are incompatible with each other, i.e. the mixture of these components leads to oil gelling, phase separation, solidifying or foaming. The oil gelling leads to a dramatic increase of the viscosity which in turn can cause engine problems and can even require the engine to be replaced, if the damage is severe. Hence, when providing novel compounds that are used in lubricating oil compositions it should always be ensured that these compounds are compatible with compounds that are conventionally used in lubricating oil compositions.

Besides compatibility with other lubricants, another area of concern is the energy efficiency. The efficiency can be increased if losses are minimized. The losses can be categorized in losses without and with load, their sum being the total losses. Within many parameters which can be influenced by geometry, material etc. lubricant viscosity has a major effect on losses without load, i.e. spilling: Losses with load can be influenced by a low friction coefficient. Thus, at a given viscosity, energy efficiency strongly depends on the friction coefficient measured for a lubricant.

The friction coefficient can be measured with several methods like Mini-Traction-Machine (MTM), SRV, 2 disc test rig etc. The benefit of a MTM is that one can see the coefficient of friction as an influence of the slide roll ratio. Slide roll ratio describes the difference of the speeds of ball and disc used in the MTM.

EP 141 473 A1 discloses the use of polyethers in lubricants.

WO 1985/00182 A1 discloses polyethers that can be considered as a random polymer which is obtained by reacting a mixture comprising ethylene oxide, propylene oxide and a lower glycol to obtain an intermediate which is further reacted with an alpha-olefin.

WO 1984/00361 A1 describes polyether that form a block copolymer comprising a block derived from ethylene oxide and propylene oxide and a block derived from C12-epoxide.

YOGARAJ NABAR: "Dow UCON™ Oil Soluble Polyalkylene Glycols, A New Type of Group V Base Oil Content", 8 TH INTERNATIONAL SYMPOSIUM ON FUELS AND LUBRICANTS, 1 Mar. 2012, discloses that the oil solubility of polyethers increases by increasing the carbon-to-oxygen ratio.

Thus, it was an objective of the presently claimed invention to provide compounds that show a low friction coefficient and that are compatible with base stocks, in particular base stocks such as mineral oils and polyalphaolefins, which are conventionally used in lubricating oil compositions for the preparation of lubricating oil compositions.

Surprisingly, it has been found that alkoxylated polyethylene glycols which are derived from polyethylene glycol and at least one $C_8$-$C_{30}$ epoxy alkane show a low friction coefficient and are compatible with base stocks that are conventionally used in lubricating oil compositions such as mineral oils and polyalphaolefins, preferably low viscosity polyalphaolefins, and consequently can be used for the formulation of lubricating oil compositions.

Hence, in one embodiment, the presently claimed invention is directed to the use of an alkoxylated polyethylene glycol of general formula (I)

(I)

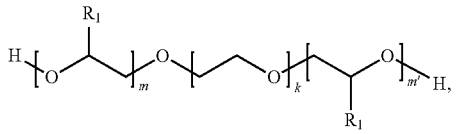

wherein m is an integer in the range of ≥0 to ≤30, m' is an integer in the range of ≥0 to ≤30, (m+m') is an integer in the range of ≥1 to ≤60, k is an integer in the range of ≥2 to ≤50, and $R^1$ denotes an unsubstituted, linear or branched, alkyl radical having 6, 7, 8, 9, 10, 11, 12, 13, 14, 15, 16, 17, 18, 19, 20, 21, 22, 23, 24, 25, 26, 27 or 28 carbon atoms, whereby the concatenations denoted by k, m and m' are distributed to form a block polymeric structure, as lubricant.

Hence, in another embodiment, the presently claimed invention is directed to the use of an alkoxylated polyethylene glycol of general formula (II)

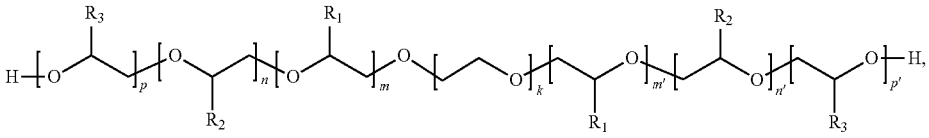

(II)

wherein m is an integer in the range of ≥1 to ≤50, m' is an integer in the range of ≥1 to ≤50, (m+m') is an integer in the range of ≥1 to ≤90, n is an integer in the range of ≥0 to ≤75, n' is an integer in the range of ≥0 to ≤75, p is an integer in the range of ≥0 to ≤90, p' is an integer in the range of ≥0 to ≤90, k is an integer in the range of ≥2 to ≤50, $R^1$ denotes an unsubstituted, linear or branched, alkyl radical having 6, 7, 8, 9, 10, 11, 12, 13, 14, 15, 16, 17, 18, 19, 20, 21, 22, 23, 24, 25, 26, 27 or 28 carbon atoms, $R^2$ denotes —$CH_2$—$CH_3$, and $R^3$ denotes —$CH_3$, whereby the concatenations denoted by k are distributed to form a block polymeric structure and the concatenations denoted by m and m' are distributed to form a block polymeric structure, or the concatenations denoted by k are distributed to form a block polymeric structure and the concatenations denoted by p, p', n, n', m and m' are distributed to form a block polymeric structure or a random polymeric structure, as lubricant.

Hence, in another embodiment, the presently claimed invention is directed to the use of an alkoxylated polyethylene glycol of general formula (II)

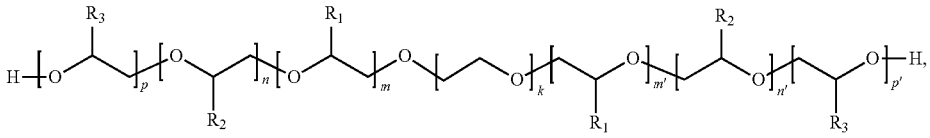

(II)

whereby the concatenations denoted by k are distributed to form a block polymeric structure and the concatenations denoted by p, p', n, n', m and m' are distributed to form a block polymeric structure or a random polymeric structure, as lubricant.

Hence, in another embodiment, the presently claimed invention is directed to the use of an alkoxylated polyethylene glycol of general formula (II)

wherein m is an integer in the range of ≥1 to ≤50, m' is an integer in the range of ≥1 to ≤50, (m+m') is an integer in the range of ≥1 to ≤90, n is an integer in the range of ≥0 to ≤75, n' is an integer in the range of ≥0 to ≤75, p is an integer in the range of ≥0 to ≤90, p' is an integer in the range of ≥0 to ≤90, k is an integer in the range of ≥2 to ≤50,

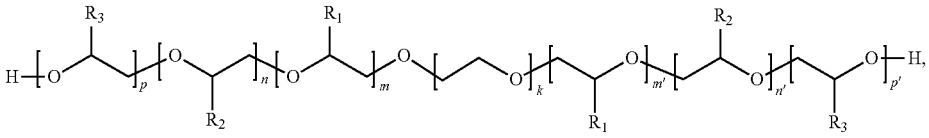

(II)

wherein m is an integer in the range of ≥1 to ≤50, m' is an integer in the range of ≥1 to ≤50, (m+m') is an integer in the range of ≥1 to ≤90, n is an integer in the range of ≥0 to ≤75, n' is an integer in the range of ≥0 to ≤75, p is an integer in the range of ≥0 to ≤90, p' is an integer in the range of ≥0 to ≤90, k is an integer in the range of ≥2 to ≤50, $R^1$ denotes an unsubstituted, linear or branched, alkyl radical having 6, 7, 8, 9, 10, 11, 12, 13, 14, 15, 16, 17, 18, 19, 20, 21, 22, 23, 24, 25, 26, 27 or 28 carbon atoms, $R^2$ denotes —$CH_2$—$CH_3$, and $R^3$ denotes —$CH_3$, whereby the concatenations denoted by k are distributed to form a block polymeric structure and the concatenations denoted by m and m' are distributed to form a block polymeric structure, or the concatenations denoted by k are distributed to form a block polymeric structure and the concatenations denoted by p, p', n, n', m and m' are distributed to form a random polymeric structure, as lubricant.

Hence, in another embodiment, the presently claimed invention is directed to the use of an alkoxylated polyethylene glycol of general formula (II)

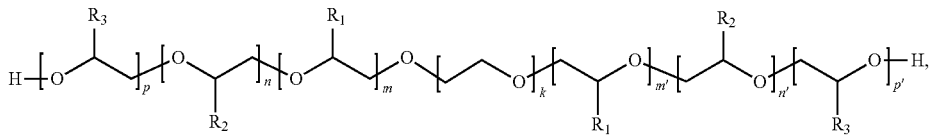

(II)

wherein m is an integer in the range of ≥1 to ≤30, m' is an integer in the range of ≥1 to ≤30, (m+m') is an integer in the range of ≥2 to ≤60, n is an integer in the range of ≥0 to ≤45, n' is an integer in the range of ≥0 to ≤45, (n+n') is an integer in the range of ≥0 to ≤80, p is an integer in the range of ≥0 to ≤90, p' is an integer in the range of ≥0 to ≤90, (p+p') is an integer in the range of ≥0 to ≤90, k is an integer in the range of ≥2 to ≤50, $R^1$ denotes an unsubstituted, linear or branched, alkyl radical having 6, 7, 8, 9, 10, 11, 12, 13, 14, 15, 16, 17, 18, 19, 20, 21, 22, 23, 24, 25, 26, 27 or 28 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, as lubricant.

By the term of "lubricant", in the sense of the presently claimed invention, is meant a substance capable of reducing friction between surfaces.

As used herein, "branched" denotes a chain of atoms with one or more side chains attached to it. Branching occurs by the replacement of a substituent, e.g., a hydrogen atom, with a covalently bonded alkyl radical.

"Alkyl radical" denotes a moiety that is constituted solely of atoms of carbon and of hydrogen and does not contain any double bonds.

The inventively claimed alkoxylated polyethylene glycols are oil soluble, which means that, when mixed with mineral oils and/or polyalphaolefins, preferably low viscosity polyalphaolefins, in a weight ratio of 10:90, 50:50 and 90:10, the inventively claimed alkoxylated polyethylene glycols do not show phase separation after standing for 24 hours at room temperature for at least two weight rations out of the three weight ratios 10:90, 50:50 and 90:10.

Preferably the alkoxylated polyethylene glycol as defined herein has a kinematic viscosity in the range of ≥40 $mm^2/s$ to ≤1300 $mm^2/s$, more preferably in the range of ≥50 $mm^2/s$ to ≤1200 $mm^2/s$, even more preferably in the range of ≥70 $mm^2/s$ to ≤1000 $mm^2/s$, most preferably in the range of ≥100 $mm^2/s$ to ≤500 $mm^2/s$, at 40° C., determined according to ASTM D 445.

Preferably the alkoxylated polyethylene glycol as defined herein has a kinematic viscosity in the range of ≥10 $mm^2/s$ to ≤100 $mm^2/s$, more preferably in the range of ≥12 $mm^2/s$ to ≤80 $mm^2/s$, even more preferably in the range of ≥14 $mm^2/s$ to ≤65 $mm^2/s$, most preferably in the range of ≥15 $mm^2/s$ to ≤60 $mm^2/s$, at 100° C., determined according to ASTM D 445.

Preferably the alkoxylated polyethylene glycol as defined herein has a viscosity index in the range of ≥100 to ≤300, more preferably in the range of ≥120 to ≤280, even more preferably in the range of ≥140 to ≤250, determined according to ASTM D 2270.

Preferably the alkoxylated polyethylene glycol as defined herein has a viscosity index of 200±60, more preferably of 200±50, even more preferably of 200±40, most preferably of 200±30, determined according to ASTM D 2270.

Preferably the alkoxylated polyethylene glycol as defined herein has a pour point in the range of ≥−60° C. to ≤20° C., more preferably in the range of ≥−50° C. to ≤15° C., even more preferably in the range of ≥−50° C. to ≤5° C., most preferably in the range of ≥~−50° C. to ≤−5° C., determined according to DIN ISO 3016.

Preferably the alkoxylated polyethylene glycol as defined herein has a weight average molecular weight Mw in the range of ≥500 to ≤20000 g/mol, more preferably in the range of ≥2000 to ≤15000 g/mol, even more preferably in the range of ≥3000 to ≤12000 g/mol determined, most preferably in the range of ≥4000 to ≤10000 g/mol, in particular in the range of ≥4000 to ≤8000 g/mol, determined according to DIN 55672-1.

Preferably the alkoxylated polyethylene glycol as defined herein has a polydispersity in the range of ≥1.05 to ≤1.60, more preferably in the range of ≥1.05 to ≤1.50, most preferably in the range of ≥1.10 to ≤1.45, determined according to DIN 55672-1.

Preferably the alkoxylated polyethylene glycol as defined herein has a hydroxyl number in the range of ≥5 to ≤50 mg KOH/g, more preferably in the range of ≥5 to ≤40 mg KOH/g, most preferably in the range of ≥7 to ≤35 mg KOH/g, determined according to DIN 53240.

Preferably k is an integer in the range of ≥3 to ≤50, more preferably k is an integer in the range of ≥3 to ≤45, most preferably in the range of ≥3 to ≤40, even more preferably in the range of ≥3 to ≤30.

Preferably m is an integer in the range of ≥1 to ≤25 and m' is an integer in the range of ≥1 to ≤25, more preferably m is an integer in the range of ≥1 to ≤20 and m' is an integer in the range of ≥1 to ≤20, even more preferably m is an integer in the range of ≥3 to ≤20 and m' is an integer in the range of ≥3 to ≤20, most preferably m is an integer in the range of ≥4 to ≤20 and m' is an integer in the range of ≥4 to ≤20.

Preferably (m+m') is an integer in the range of ≥3 to ≤65, more preferably (m+m') is an integer in the range of ≥3 to ≤50, even more preferably (m+m') is an integer in the range of ≥3 to ≤40, most preferably (m+m') is an integer in the range of ≥4 to ≤40.

Preferably the ratio of (m+m') to k is in the range of 0.3:1 to 6:1, more preferably in the range of 0.5:1 to 4:1, most preferably in the range of 1:1 to 3:1, even more preferably in the range of 1:1 to 2:1, in particular in the range of 1.2:1 to 1.8:1.

Preferably n is an integer in the range of ≥3 to ≤40 and n' is an integer in the range of ≥3 to ≤40, more preferably n is an integer in the range of ≥3 to ≤30 and n' is an integer in the range of ≥3 to ≤30, even more preferably n is an integer in the range of ≥3 to ≤20 and n' is an integer in the range of ≥3 to ≤20.

Preferably (n+n') is an integer in the range of ≥3 to ≤60, more preferably (n+n') is an integer in the range of ≥3 to ≤40, even more preferably (n+n') is an integer in the range of ≥5 to ≤30.

Preferably p is an integer in the range of ≥3 to ≤50 and p' is an integer in the range of ≥3 to ≤50, more preferably p is an integer in the range of ≥3 to ≤40 and p' is an integer in the range of ≥3 to ≤40, even more preferably p is an integer in the range of ≥3 to ≤30 and p' is an integer in the range of ≥3 to ≤30.

wherein m is an integer in the range of ≥1 to ≤30, m' is an integer in the range of ≥1 to ≤30, (m+m') is an integer in the range of ≥3 to ≤50, n is an integer in the range of ≥3 to ≤40, n' is an integer in the range of ≥3 to ≤40, (n+n') is an integer in the range of ≥6 to ≤40, p is an integer in the range of ≥0 to ≤75, p' is an integer in the range of ≥0 to ≤75, (p+p') is an integer in the range of ≥0 to ≤90, k is an integer in the range of ≥3 to ≤40, $R^1$ denotes an unsubstituted, linear alkyl radical having 6, 7, 8, 9, 10, 11, 12, 13, 14, 15, 16, 17 or 18 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, as a lubricant.

In another preferred embodiment the presently claimed invention is directed to the use of an alkoxylated polyethylene glycol of general formula (II)

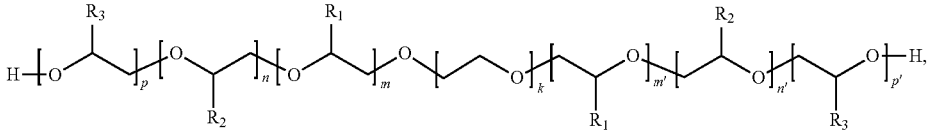

(II)

Preferably (p+p') is an integer in the range of ≥5 to ≤90, more preferably (p+p') is an integer in the range of ≥5 to ≤80, even more preferably (p+p') is an integer in the range of ≥5 to ≤70.

Preferably $R^1$ denotes an unsubstituted, linear alkyl radical having 6, 7, 8, 9, 10, 11, 12, 13, 14, 15, 16, 17 or 18 carbon atoms. More preferably $R^1$ denotes an unsubstituted, linear alkyl radical having 8, 9, 10, 11, 12, 13, 14, 15 or 16 carbon atoms. Most preferably $R^1$ denotes an unsubstituted, linear alkyl radical having 8, 9, 10, 11 or 12 carbon atoms.

In case the alkoxylated polyethylene glycol comprises units, wherein $R^2$ denotes —$CH_2$—$CH_3$, the ratio of (n+n') to k is in the range of 1:1 to 10:1, more preferably in the range of 1:1 to 7:1, even more preferably in the range of 1:1 to 6:1, most preferably in the range of 2:1 to 6:1.

In case the alkoxylated polyethylene glycol comprises units, wherein $R^3$ denotes —$CH_3$, the ratio of (p+p') to k is in the range of 0.5:1 to 10:1, more preferably in the range of 0.8:1 to 5:1, even more preferably in the range of 0.8:1 to 4:1, most preferably in the range of 1:1 to 3:1.

In another preferred embodiment the presently claimed invention is directed to the use of an alkoxylated polyethylene glycol of general formula (II)

wherein m is an integer in the range of ≥1 to ≤30, m' is an integer in the range of ≥1 to ≤30, (m+m') is an integer in the range of ≥3 to ≤50, n is an integer in the range of ≥3 to ≤20, n' is an integer in the range of ≥3 to ≤20, (n+n') is an integer in the range of ≥6 to ≤30, p is an integer in the range of ≥0 to ≤75, p' is an integer in the range of ≥0 to ≤75, (p+p') is an integer in the range of ≥0 to ≤90, k is an integer in the range of ≥3 to ≤40, $R^1$ denotes an unsubstituted, linear alkyl radical having 9, 10 or 11 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, as a lubricant.

In a more preferred embodiment the presently claimed invention is directed to the use of an alkoxylated polyethylene glycol of general formula (II)

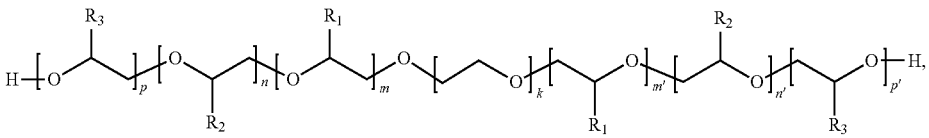

(II)

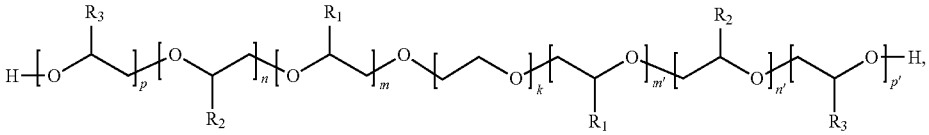

(II)

wherein m is an integer in the range of ≥1 to ≤30, m' is an integer in the range of ≥1 to ≤30, (m+m') is an integer in the range of ≥3 to ≤50, n is an integer in the range of ≥3 to ≤20, n' is an integer in the range of ≥3 to ≤20, (n+n') is an integer in the range of ≥6 to ≤30, p is an integer in the range of ≥0 to ≤75, p' is an integer in the range of ≥0 to ≤75, (p+p') is an integer in the range of ≥0 to ≤90, k is an integer in the range of ≥3 to ≤40, $R^1$ denotes an unsubstituted, linear alkyl radical having 6, 7, 8, 9, 10, 11, 12, 13, 14, 15, 16, 17 or 18 carbon atoms, $R^2$ denotes —$CH_2$—$CH_3$, and $R^3$ denotes —$CH_3$, $R^1$ denotes an unsubstituted, linear alkyl radical having 9, 10 or 11 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (n+n') to k is in the range of 1:1 to 6:1, as a lubricant.

In a most preferred embodiment the presently claimed invention is directed to the use of an alkoxylated polyethylene glycol of general formula (II)

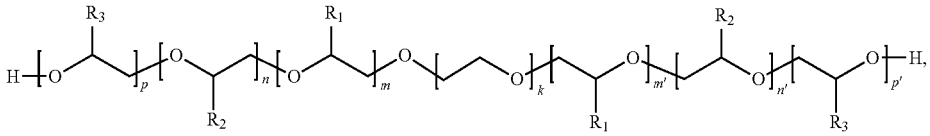

(II)

whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 3:1 and the ratio of (n+n') to k is in the range of 1:1 to 6:1, as a lubricant.

In a more preferred embodiment the presently claimed invention is directed to the use of an alkoxylated polyethylene glycol of general formula (II)

wherein m is an integer in the range of ≥1 to ≤25, m' is an integer in the range of ≥1 to ≤25, (m+m') is an integer in the range of ≥3 to ≤40, n is an integer in the range of ≥6 to ≤15, n' is an integer in the range of ≥6 to ≤15, (n+n') is an integer in the range of ≥12 to ≤25, p is an integer in the range of ≥0 to ≤25, p' is an integer in the range of ≥0 to ≤25, (p+p') is an integer in the range of ≥0 to ≤70,

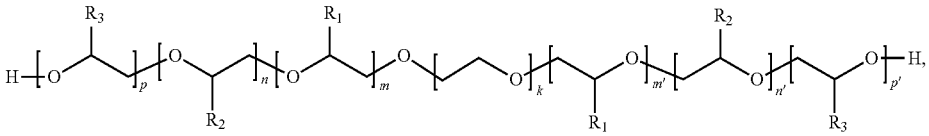

(II)

wherein m is an integer in the range of ≥1 to ≤30, m' is an integer in the range of ≥1 to ≤30, (m+m') is an integer in the range of ≥3 to ≤50, n is an integer in the range of ≥3 to ≤20, n' is an integer in the range of ≥3 to ≤20, (n+n') is an integer in the range of ≥6 to ≤30, p is an integer in the range of ≥0 to ≤75, p' is an integer in the range of ≥0 to ≤75, (p+p') is an integer in the range of ≥0 to ≤90, k is an integer in the range of ≥3 to ≤30, k is an integer in the range of ≥3 to ≤30, $R^1$ denotes an unsubstituted, linear alkyl radical having 8, 9, 10, 11 or 12 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (n+n') to k is in the range of 1:1 to 6:1, as a lubricant.

In another preferred embodiment the presently claimed invention is directed to the use of an alkoxylated polyethylene glycol of general formula (II)

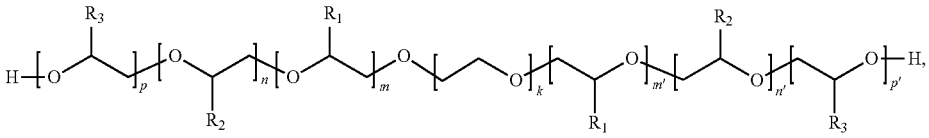

(II)

wherein
m is an integer in the range of ≥1 to ≤25,
m' is an integer in the range of ≥1 to ≤25,
(m+m') is an integer in the range of ≥3 to ≤50,
n is 0,
n' is 0,
p is an integer in the range of ≥3 to ≤45,
p' is an integer in the range of ≥3 to ≤45,
(p+p') is an integer in the range of ≥6 to ≤80,
k is an integer in the range of ≥3 to ≤30,
k is an integer in the range of ≥3 to ≤30,
$R^1$ denotes an unsubstituted, linear alkyl radical having 9, 10 or 11 carbon atoms,
$R^2$ denotes —$CH_2$—$CH_3$,
and
$R^3$ denotes —$CH_3$,
whereby the concatenations denoted by k are distributed to form a block polymeric structure and the concatenations denoted by p, p', n, n', m and m' are distributed to form a block polymeric structure or a random polymeric structure, as a lubricant.

In a more preferred embodiment the presently claimed invention is directed to the use of an alkoxylated polyethylene glycol of general formula (II)

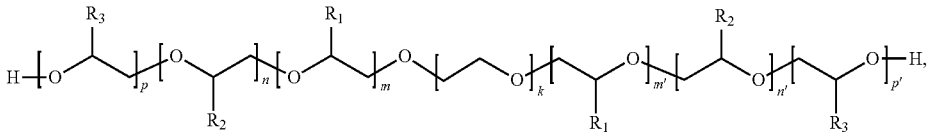

(II)

$R^1$ denotes an unsubstituted, linear alkyl radical having 6, 7, 8, 9, 10, 11, 12, 13, 14, 15, 16, 17 or 18 carbon atoms,
$R^2$ denotes —$CH_2$—$CH_3$,
and
$R^3$ denotes —$CH_3$,
whereby the concatenations denoted by k are distributed to form a block polymeric structure and the concatenations denoted by p, p', n, n', m and m' are distributed to form a block polymeric structure or a random polymeric structure, as a lubricant.

In another preferred embodiment the presently claimed invention is directed to the use of an alkoxylated polyethylene glycol of general formula (II)

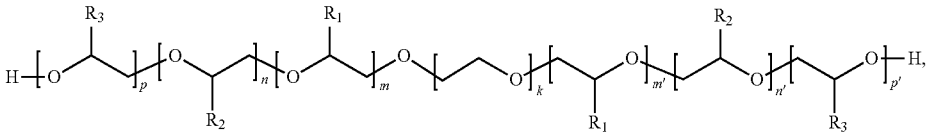

(II)

wherein
m is an integer in the range of ≥1 to ≤30,
m' is an integer in the range of ≥1 to ≤30,
(m+m') is an integer in the range of ≥3 to ≤50,
n is 0,
n' is 0,
p is an integer in the range of ≥3 to ≤45,
p' is an integer in the range of ≥3 to ≤45,
(p+p') is an integer in the range of ≥6 to ≤80,
k is an integer in the range of ≥3 to ≤30,
$R^1$ denotes an unsubstituted, linear alkyl radical having 6, 7, 8, 9, 10, 11, 12, 13, 14, 15, 16, 17 or 18 carbon atoms,
$R^2$ denotes —$CH_2$—$CH_3$,
and
$R^3$ denotes —$CH_3$, wherein
m is an integer in the range of ≥1 to ≤25,
m' is an integer in the range of ≥1 to ≤25,
(m+m') is an integer in the range of ≥3 to ≤50,
n is 0,
n' is 0,
p is an integer in the range of ≥3 to ≤45,
p' is an integer in the range of ≥3 to ≤45,
(p+p') is an integer in the range of ≥6 to ≤80,
whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (p+p') to k is in the range of 0.8:1 to 4:1, as a lubricant.

In a most preferred embodiment the presently claimed invention is directed to the use of an alkoxylated polyethylene glycol of general formula (II)

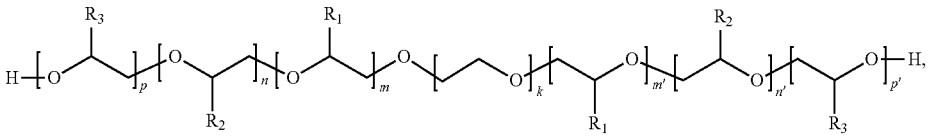

(II)

wherein m is an integer in the range of ≥1 to ≤25, m' is an integer in the range of ≥1 to ≤25, (m+m') is an integer in the range of ≥3 to ≤50, n is 0, n' is 0, p is an integer in the range of ≥3 to ≤40, p' is an integer in the range of ≥3 to ≤40, (p+p') is an integer in the range of ≥5 to ≤70, k is an integer in the range of ≥3 to ≤30, $R^1$ denotes an unsubstituted, linear alkyl radical having 8, 9, 10, 11 or 12 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (p+p') to k is in the range of 0.8:1 to 4:1, as a lubricant.

In a most preferred embodiment the presently claimed invention is directed to the use of an alkoxylated polyethylene glycol of general formula (II)

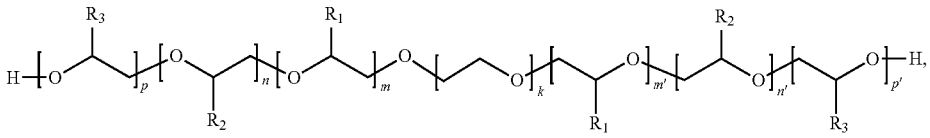

(II)

$R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (p+p') to k is in the range of 0.8:1 to 4:1, as a lubricant.

In a most preferred embodiment the presently claimed invention is directed to the use of an alkoxylated polyethylene glycol of general formula (II)

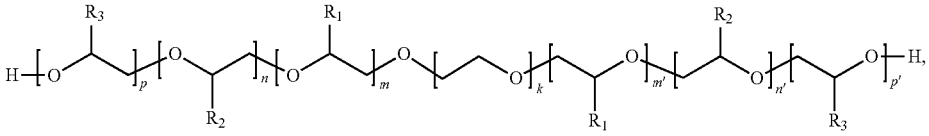

(II)

wherein m is an integer in the range of ≥2 to ≤25, m' is an integer in the range of ≥2 to ≤25, (m+m') is an integer in the range of ≥4 to ≤40, n is 0, n' is 0, p is an integer in the range of ≥4 to ≤40, p' is an integer in the range of ≥4 to ≤40, (p+p') is an integer in the range of ≥5 to ≤70, k is an integer in the range of ≥3 to ≤30, $R^1$ denotes an unsubstituted, linear alkyl radical having 9, 10 or 11 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 wherein m is an integer in the range of ≥1 to ≤25, m' is an integer in the range of ≥1 to ≤25, (m+m') is an integer in the range of ≥3 to ≤50, n is 0, n' is 0, p is an integer in the range of ≥3 to ≤40, p' is an integer in the range of ≥3 to ≤40, (p+p') is an integer in the range of ≥5 to ≤70, k is an integer in the range of ≥3 to ≤30, $R^1$ denotes an unsubstituted, linear alkyl radical having 9, 10 or 11 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (p+p') to k is in the range of 0.8:1 to 4:1, as a lubricant.

In a most preferred embodiment the presently claimed invention is directed to the use of an alkoxylated polyethylene glycol of general formula (II)

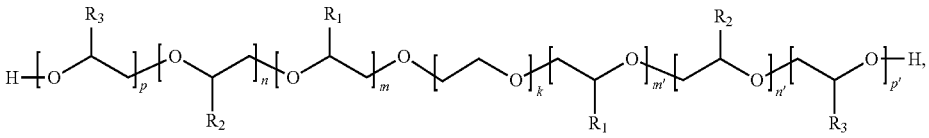

(II)

wherein m is an integer in the range of ≥2 to ≤25, m' is an integer in the range of ≥2 to ≤25, (m+m') is an integer in the range of ≥4 to ≤40, n is an integer in the range of ≥3 to ≤20, n' is an integer in the range of ≥3 to ≤20, (n+n') is an integer in the range of ≥6 to ≤30, p is 0, p' is 0, k is an integer in the range of ≥3 to ≤30, $R^1$ denotes an unsubstituted, linear alkyl radical having 9, 10 or 11 carbon atoms, $R^2$ denotes —$CH_2$—$CH_3$, and $R^3$ denotes —$CH_3$, whereby the concatenations denoted by k are distributed to form a block polymeric structure and the concatenations denoted by p, p', n, n', m and m' are distributed to form a block polymeric structure or a random polymeric structure, wherein the ratio of (m+m') to k is in the range of 1:1 to 2:1 and the ratio of (n+n') to k is in the range of 2:1 to 6:1, as a lubricant.

In a most preferred embodiment the presently claimed invention is directed to the use of an alkoxylated polyethylene glycol of general formula (I)

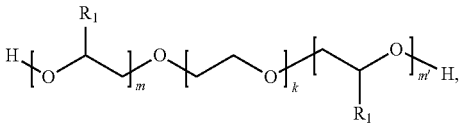

(I)

wherein m is an integer in the range of ≥2 to ≤25, m' is an integer in the range of ≥2 to ≤25, (m+m') is an integer in the range of ≥4 to ≤40, k is an integer in the range of ≥3 to ≤30, and $R^1$ denotes an unsubstituted, linear or branched, alkyl radical having 6, 7, 8, 9, 10, 11, 12, 13 or 14 carbon atoms, whereby the concatenations denoted by k, m and m' are distributed to form a block polymeric structure, wherein the ratio of (m+m') to k is in the range of 1:1 to 3:1, as lubricant.

The alkoxylated polyethylene glycols are obtained by reacting at least one polyethylene glycol block polymer with at least one $C_8$-$C_{30}$ epoxy alkane and optionally at least one epoxide selected from the group consisting of ethylene oxide, propylene oxide and butylene oxide in the presence of at least one catalyst. In case at least one epoxide selected from the group consisting of ethylene oxide, propylene oxide and butylene oxide is used, the at least one $C_8$-$C_{30}$ epoxy alkane and the at least one epoxide selected from the group consisting of ethylene oxide, propylene oxide and butylene oxide can either be added as a mixture of epoxides to obtain a random copolymer or in portions, whereby each portion contains a different epoxide, to obtain a block copolymer.

Preferably the at least one $C_8$-$C_{30}$ epoxy alkane is selected from the group consisting of 1,2-epoxyoctane; 1,2-epoxynonane; 1,2-epoxydecane; 1,2-epoxyundecane; 1,2-epoxydodecane; 1,2-epoxytridecane; 1,2-epoxytetradecane; 1,2-epoxypentadecane; 1,2-epoxyhexadecane; 1,2-epoxyheptadecane; 1,2-epoxyoctadecane; 1,2-epoxynonadecane; 1,2-epoxyicosane; 1,2-epoxyunicosane; 1,2-epoxydocosane; 1,2-epoxytricosane; 1,2-epoxytetracosane; 1,2-epoxypentacosane; 1,2-epoxyhexacosane; 1,2-epoxyheptacosane; 1,2-epoxyoctacosane; 1,2-epoxynonacosane and 1,2-epoxytriacontane.

Preferably the at least one catalyst is a base or a double metal cyanide catalyst (DMC catalyst). More preferably the at least one catalyst is selected from the group consisting of alkaline earth metal hydroxides such as calcium hydroxide, strontium hydroxide and barium hydroxide, alkali metal hydroxides such as lithium hydroxide, sodium hydroxide, potassium hydroxide, rubidium hydroxide and caesium hydroxide and alkali metal alkoxylates such as potassium tert-butoxylate. Most preferably the at least one catalyst is sodium hydroxide or potassium tert-butoxylate. Most preferably the at least one catalyst is potassium tert-butoxylate.

In case the catalyst is a base, any inert solvents capable of dissolving alkoxylated polyethylene glycol and polyethylene glycol may be used as solvents during the reaction or as solvents required for working up the reaction mixture in cases where the reaction is carried out without solvents. The following solvents are mentioned as examples: methylene chloride, trichloroethylene, tetrahydrofuran, dioxane, methyl ethyl ketone, methylisobutyl ketone, ethyl acetate and isobutyl acetate.

In case the catalyst is a base, the amount of catalysts used is preferably in the range from 0.01 to 1.0, more preferably in the range from 0.05 to 0.5% by weight, based on the total amount of the alkoxylated polyethylene glycol. The reaction is preferably carried out at a temperature in the range of 70 to 200° C., more preferably from 100 to 160° C. The pressure is preferably in the range from 1 bar to 150 bar, more preferably in the range from 3 to 30 bar.

In case a DMC catalyst is used, it is in principle possible to use all types of DMC catalysts known from the prior art. Preference is given to using double metal cyanide catalysts of the general formula (1):

$$M^1_a[M^2(CN)_b(A)_c]_d.fM^1gX_n.h(H_2O).eL, \quad (1)$$

wherein $M^1$ is a metal ion selected from the group comprising $Zn^{2+}$, $Fe^{2+}$, $Co^{3+}$, $Ni^{2+}$, $Mn^{2+}$, $Co^{2+}$, $Sn^{2+}$, $Pb^{2+}$, $Mo^{4+}$, $Mo^{6+}$, $Al^{3+}$, $V^{4+}$, V+, $Sr^{2+}$, W6+, $Cr^{2+}$, $Cr^{3+}$ and $Cd^{2+}$, $M^2$ is a metal ion selected from the group comprising $Fe^{2+}$, $Fe^{3+}$, $Co^{2+}$, $Co^{3+}$, $Mn^{2+}$, $Mn^{3+}$, $V^{4+}$, $V^{5+}$, $Cr^{2+}$, $Cr^{3+}$, $Rh^{3+}$, $Ru^{2+}$ and $Ir^{3+}$, $M^1$ and $M^2$ are identical or different, A is an anion selected from the group comprising halide, hydroxide, sulfate, carbonate, cyanide, thiocyanate, isocyanate, cyanate, carboxylate, oxalate and nitrate, X is an anion selected from the group comprising halide, hydroxide, sulfate, carbonate, cyanide, thiocyanate, isocyanate, cyanate, carboxylate, oxalate and nitrate, L is a water-miscible ligand selected from the group comprising alcohols, aldehydes, ketones, ethers, poly-ethers, esters, ureas, amides, nitriles and sulfides, and a, b, c, d, g and n are selected so that the compound is electrically neutral and e is the coordination number of the ligand or zero, f is a fraction or integer greater than or equal to zero, h is a fraction or integer greater than or equal to zero.

Such compounds are generally known and can be prepared, for example, by the process described in EP 0 862 947 B1 by combining the aqueous solution of a water-soluble metal salt with the aqueous solution of a hexacyanometallate compound, in particular of a salt or an acid, and, if necessary, adding a water-soluble ligand thereto either during or after the combination of the two solutions.

DMC catalysts are usually prepared as a solid and used as such. The catalyst is typically used as powder or in suspension. However, other ways known to those skilled in the art for using catalysts can likewise be employed. In a preferred embodiment, the DMC catalyst is dispersed with an inert or non-inert suspension medium which can be, for example, the product to be produced or an intermediate by suitable measures, e.g. milling. The suspension produced in this way is used, if appropriate after removal of interfering amounts of water by methods known to those skilled in the art, e.g. stripping with or without use of inert gases such as nitrogen and/or noble gases. Suitable suspension media are, for example, toluene, xylene, tetrahydrofuran, acetone, 2-methylpentanone, cyclohexanone and also polyether alcohols according to the invention and mixtures thereof. The catalyst is preferably used in a suspension in a polyol as described, for example, in EP 0 090 444 A.

In another embodiment, the presently claimed invention is directed to the use of at least one alkoxylated polyethylene glycol as defined above or a mixture of polyethylene glycols as defined above for the preparation of a lubricating oil composition.

In another embodiment, the presently claimed invention is directed to a lubricating oil composition comprising at least one alkoxylated polyethylene glycol as defined above or a mixture of alkoxylated polyethylene glycol as defined above. The lubricating oil composition contains at least one alkoxylated polyethylene glycol in a small amount (when the alkoxylated polyethylene glycol is used as a friction modifier), in a medium amount (when the (when the alkoxylated polyethylene glycol is used as co-solvent) or in a large amount (when the alkoxylated polyethylene glycol is used as a base stock). Preferably the lubricating oil composition comprises ≥1% to ≤10% by weight or ≥1% to ≤40% by weight or ≥20% to ≤100% by weight, more preferably ≥1% to ≤5% by weight or ≥1% to ≤35% by weight or ≥25% to ≤100% by weight, most preferably 1% to ≤2% by weight or ≥2% to ≤30% by weight or ≥30% to ≤100% by weight, of at least one alkoxylated polyethylene glycol as defined above, related to the total amount of the lubricating oil composition.

Preferably, the lubricating oil composition according to the presently claimed invention has a friction coefficient in the range of ≥0.003 to ≤0.030, more preferably in the range of ≥0.03 to ≤0.028, even more preferably in the range of ≥0.005 to ≤0.027, most preferably in the range of ≥0.010 to ≤0.025 at 25% slide roll ratio (SRR), determined using mini-traction machine (MTM) measurements at 70° C. and 1 GPa.

In another embodiment, the presently claimed invention relates to an industrial oil comprising at least one alkoxylated polyethylene glycol.

Lubricating oil compositions comprising at least one alkoxylated polyethylene glycol as defined above or a mixture of polyethylene glycols as defined above can be used for various applications such as light, medium and heavy duty engine oils, industrial engine oils, marine engine oils, automotive engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, moulding fluids, gun, pistol and rifle lubricants or watch lubricants and food grade approved lubricants.

A lubricating oil composition can comprise of base stocks, co-solvents and a variety of different additives in varying ratios.

Preferably the lubricating oil composition further comprises base stocks selected from the group consisting of mineral oils (Group I, II or III oils), polyalphaolefins (Group IV oils), polymerized and interpolymerized olefins, alkyl naphthalenes, alkylene oxide polymers, silicone oils, phosphate esters and carboxylic acid esters (Group V oils). Preferably the lubricating oil comprises ≥50% to ≤99% by weight or ≥80% to ≤99% by weight or ≥90% to ≤99% by weight base stocks, related to the total amount of the lubricating oil composition.

Definitions for the base stocks in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in the following table b) Group II base stocks contain greater than or equal to 90 percent saturates and less than or equal to 0.03 percent sulphur and have a viscosity index greater than or equal to 80 and less than 120 using the test methods specified in the following table c) Group III base stocks contain greater than or equal to 90 percent saturates and less than or equal to 0.03 percent sulphur and have a viscosity index greater than or equal to 120 using the test methods specified in the following table Analytical Methods for Base Stock

| Property | Test Method |
|---|---|
| Saturates | ASTM D 2007 |
| Viscosity Index | ASTM D 2270 |
| Sulphur | ASTM D 2622<br>ASTM D 4294<br>ASTM D 4927<br>ASTM D 3120 |

Group IV base stocks contain polyalphaolefins. Synthetic lower viscosity fluids suitable for the present invention include the polyalphaolefins (PAOs) and the synthetic oils from the hydrocracking or hydroisomerization of Fischer Tropsch high boiling fractions including waxes. These are both stocks comprised of saturates with low impurity levels consistent with their synthetic origin. The hydroisomerized Fischer Tropsch waxes are highly suitable base stocks, comprising saturated components of iso-paraffinic character (resulting from the isomerization of the predominantly n-paraffins of the Fischer Tropsch waxes) which give a good blend of high viscosity index and low pour point. Processes for the hydroisomerization of Fischer Tropsch waxes are described in U.S. Pat. Nos. 5,362,378; 5,565,086; 5,246,566 and 5,135,638, as well in EP 710710, EP 321302 and EP 321304.

Polyalphaolefins suitable for the present invention, as either lower viscosity or high viscosity fluids depending on their specific properties, include known PAO materials which typically comprise relatively low molecular weight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-octene, poly-1-decene, and poly-1-dodecene, although the dimers of higher olefins in the range of $C_{14}$ to $C_{18}$ provide low viscosity base stocks.

Low viscosity PAO fluids suitable for the present invention, may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example, the methods disclosed by U.S. Pat. Nos. 3,149,178 or 3,382,291 may be conveniently used herein. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,308 (Larkin); U.S. Pat. No. 4,910,355 (Shubkin); U.S. Pat. No. 4,956,122 (Watts); and U.S. Pat. No. 5,068,487 (Theriot).

Group V base stocks contain any base stocks not described by Groups I to IV. Examples of Group V base stocks include alkyl naphthalenes, alkylene oxide polymers, silicone oils, phosphate esters and carboxylic acid esters.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Further carboxylic acid esters suitable for the present invention include the esters of mono and polybasic acids with monoalkanols (simple esters) or with mixtures of mono and polyalkanols (complex esters), and the polyol esters of monocarboxylic acids (simple esters), or mixtures of mono and polycarboxylic acids (complex esters). Esters of the mono/polybasic type include, for example, the esters of monocarboxylic acids such as heptanoic acid, and dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, or mixtures thereof with polyalkanols, etc. Specific examples of these types of esters include nonyl heptanoate, dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, dibutyl-TMP-adipate, etc.

Also suitable for the present invention are esters, such as those obtained by reacting one or more polyhydric alcohols, preferably the hindered polyols such as the neopentyl polyols, e.g. neopentyl glycol, trimethylol ethane, 2-methyl-2-propyl-1,3-propanediol, trimethylol propane, trimethylol butane, pentaerythritol and dipentaerythritol with monocarboxylic acids containing at least 4 carbons, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures thereof, with polycarboxylic acids.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, oly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The lubricating oil composition of the invention optionally further includes at least one other performance additive. The other performance additives include dispersants, metal deactivators, detergents, viscosity modifiers, extreme pressure agents (typically boron- and/or sulphur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents, friction modifiers and mixtures thereof.

The total combined amount of the other performance additives (excluding the viscosity modifiers) present on an oil free basis may include ranges of 0% by weight to 25% by weight, or 0.01% by weight to 20% by weight, or 0.05% by weight to 15% by weight or 0.5% by weight to 10% by weight, or 1 to 5% by weight of the composition.

Although one or more of the other performance additives may be present, it is common for the other performance additives to be present in different amounts relative to each other.

In one embodiment the lubricating composition further includes one or more viscosity modifiers.

When present the viscosity modifier may be present in an amount of 0.5% by weight to 70% by weight, 1% by weight to 60% by weight, or 5% by weight to 50% by weight, or 10% by weight to 50% by weight of the lubricating composition.

Viscosity modifiers include (a) polymethacrylates, (b) esterified copolymers of (II) a vinyl aromatic monomer and (ii) an unsaturated carboxylic acid, anhydride, or derivatives thereof, (c) esterified interpolymers of (II) an alpha-olefin; and (ii) an unsaturated carboxylic acid, anhydride, or derivatives thereof, or (d) hydrogenated copolymers of styrene-butadiene, (e) ethylene-propylene copolymers, (f) polyisobutenes, (g) hydrogenated styrene-isoprene polymers, (h) hydrogenated isoprene polymers, or (II) mixtures thereof.

In one embodiment the viscosity modifier includes (a) a polymethacrylate, (b) an esterified copolymer of (II) a vinyl aromatic monomer; and (ii) an unsaturated carboxylic acid, anhydride, or derivatives thereof, (c) an esterified interpolymer of (II) an alpha-olefin; and (ii) an unsaturated carboxylic acid, anhydride, or derivatives thereof, or (d) mixtures thereof.

Extreme pressure agents include compounds containing boron and/or sulphur and/or phosphorus.

The extreme pressure agent may be present in the lubricating composition at 0% by weight to 20% by weight, or 0.05% by weight to 10% by weight, or 0.1% by weight to 8% by weight of the lubricating composition.

In one embodiment the extreme pressure agent is a sulphur-containing compound. In one embodiment the sulphur-containing compound may be a sulphurised olefin, a polysulphide, or mixtures thereof. Examples of the sulphurised olefin include a sulphurised olefin derived from propylene, isobutylene, pentene; an organic sulphide and/or polysulphide including benzyldisulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N',N-dialkyl dithiocarbamates; or mixtures thereof.

In one embodiment the sulphurised olefin includes a sulphurised olefin derived from propylene, isobutylene, pentene or mixtures thereof.

In one embodiment the extreme pressure agent sulphur-containing compound includes a dimercaptothiadiazole or derivative, or mixtures thereof. Examples of the dimercaptothiadiazole include compounds such as 2,5-dimercapto-1,3,4-thiadiazole or a hydrocarbyl-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form derivatives or oligomers of two or more of said thiadiazole units. Suitable 2,5-dimercapto-1,3,4-thiadiazole derived compounds include for example 2,5-bis(tert-nonyldithio)-1,3,4-thiadiazole or 2-tert-nonyldithio-5-mercapto-1,3,4-thiadiazole. The number of carbon atoms on the hydrocarbyl substituents of the hydrocarbyl-substituted 2,5-dimercapto-1,3,4-thiadiazole typically include 1 to 30, or 2 to 20, or 3 to 16.

In one embodiment the dimercaptothiadiazole may be a thiadiazole-functionalised dispersant.

A detailed description of the thiadiazole-functionalised dispersant is described is paragraphs [0028] to [0052] of International Publication WO 2008/014315.

The thiadiazole-functionalised dispersant may be prepared by a method including heating, reacting or complexing a thiadiazole compound with a dispersant substrate. The thiadiazole compound may be covalently bonded, salted, complexed or otherwise solubilised with a dispersant, or mixtures thereof.

The relative amounts of the dispersant substrate and the thiadiazole used to prepare the thiadiazole-functionalised dispersant may vary. In one embodiment the thiadiazole compound is present at 0.1 to 10 parts by weight relative to 100 parts by weight of the dispersant substrate. In different embodiments the thiadiazole compound is present at greater than 0.1 to 9, or greater than 0.1 to less than 5, or 0.2 to less than 5: to 100 parts by weight of the dispersant substrate. The relative amounts of the thiadiazole compound to the dispersant substrate may also be expressed as (0.1-10):100, or (>0.1-9):100, (such as (>0.5-9):100), or (0.1 to less than 5): 100, or (0.2 to less than 5): 100.

In one embodiment the dispersant substrate is present at 0.1 to 10 parts by weight relative to 1 part by weight of the thiadiazole compound. In different embodiments the dispersant substrate is present at greater than 0.1 to 9, or greater than 0.1 to less than 5, or about 0.2 to less than 5: to 1 part by weight of the thiadiazole compound. The relative amounts of the dispersant substrate to the thiadiazole compound may also be expressed as (0.1-10):1, or (>0.1-9):1, (such as (>0.5-9):1), or (0.1 to less than 5): 1, or (0.2 to less than 5): 1.

The thiadiazole-functionalised dispersant may be derived from a substrate that includes a succinimide dispersant (for example, N-substituted long chain alkenyl succinimides, typically a polyisobutylene succinimide), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyetheramine dispersant, a viscosity modifier containing dispersant functionality (for example polymeric viscosity index modifiers (VMs) containing dispersant functionality), or mixtures thereof. In one embodiment the dispersant substrate includes a succinimide dispersant, an ester-containing dispersant or a Mannich dispersant.

In one embodiment the extreme pressure agent includes a boron-containing compound. The boron-containing compound includes a borate ester (which in some embodiments may also be referred to as a borated epoxide), a borated alcohol, a borated dispersant, a borated phospholipid or mixtures thereof. In one embodiment the boron-containing compound may be a borate ester or a borated alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms selected from the group consisting of boric acid (including metaboric acid, orthoboric acid and tetraboric acid), boric oxide, boron trioxide and alkyl borates. The borate ester may also be prepared from boron halides.

In one embodiment suitable borate ester compounds include tripropyl borate, tributyl borate, tripentyl borate, trihexyl borate, triheptyl borate, trioctyl borate, trinonyl borate and tridecyl borate. In one embodiment the borate ester compounds include tributyl borate, tri-2-ethylhexyl borate or mixtures thereof.

In one embodiment, the boron-containing compound is a borated dispersant, typically derived from an N-substituted long chain alkenyl succinimide. In one embodiment the borated dispersant includes a polyisobutylene succinimide. Borated dispersants are described in more detail in U.S. Pat. No. 3,087,936; and U.S. Pat. No. 3,254,025.

In one embodiment the borated dispersant may be used m combination with a sulphur-containing compound or a borate ester.

In one embodiment the extreme pressure agent is other than a borated dispersant.

The number average molecular weight of the hydrocarbon from which the long chain alkenyl group was derived includes ranges of 350 to 5000, or 500 to 3000, or 550 to 1500. The long chain alkenyl group may have a number average molecular weight of 550, or 750, or 950 to 1000.

The N-substituted long chain alkenyl succinimides are borated using a variety of agents including boric acid (for example, metaboric acid, orthoboric acid and tetraboric acid), boric oxide, boron trioxide, and alkyl borates. In one embodiment the borating agent is boric acid which may be used alone or in combination with other borating agents.

The borated dispersant may be prepared by blending the boron compound and the N-substituted long chain alkenyl succinimides and heating them at a suitable temperature, such as, 80° C. to 250° C., or 90° C. to 230° C., or 100° C. to 210° C., until the desired reaction has occurred. The molar ratio of the boron compounds to the N-substituted long chain alkenyl succinimides may have ranges including 10:1 to 1:4, or 4:1 to 1:3; or the molar ratio of the boron compounds to the N-substituted long chain alkenyl succinimides may be 1:2. Alternatively, the ratio of moles B:moles N (that is, atoms of B:atoms of N) in the borated dispersant may be 0.25:1 to 10:1 or 0.33:1 to 4:1 or 0.2:1 to 1.5:1, or 0.25:1 to 1.3:1 or 0.8:1 to 1.2:1 or about 0.5:1 An inert liquid may be used in performing the reaction. The liquid may include toluene, xylene, chlorobenzene, dimethylformamide or mixtures thereof. In one embodiment the lubricating composition further includes a borated phospholipid. The borated phospholipid may be derived from boronation of a phospholipid (for example boronation may be carried out with boric acid). Phospholipids and lecithins are described in detail in Encyclopedia of Chemical Technology, Kirk and Othmer, 3rd Edition, in "Fats and Fatty Oils", Volume 9, pages 795-831 and in "Lecithins", Volume 14, pages 250-269.

The phospholipid may be any lipid containing a phosphoric acid, such as lecithin or cephalin, or derivatives thereof. Examples of phospholipids include phosphatidylcholine, phosphatidylserine, phosphatidylinositol, phosphatidylethanolamine, phosphotidic acid and mixtures thereof. The phospholipids may be glycerophospholipids, glycerol derivatives of the above list of phospholipids. Typically, the glycerophospholipids have one or two acyl, alkyl or alkenyl groups on a glycerol residue. The alkyl or alkenyl groups may contain 8 to 30, or 8 to 25, or 12 to 24 carbon atoms. Examples of suitable alkyl or alkenyl groups include octyl, dodecyl, hexadecyl, octadecyl, docosanyl, octenyl, dodecenyl, hexadecenyl and octadecenyl.

Phospholipids may be prepared synthetically or derived from natural sources. Synthetic phospholipids may be prepared by methods known to those in the art. Naturally derived phospholipids are often extracted by procedures known to those in the art. Phospholipids may be derived from animal or vegetable sources. A useful phospholipid is derived from sunflower seeds. The phospholipid typically contains 35% to 60% phosphatidylcholine, 20% to 35% phosphatidylinositol, 1% to 25% phosphatidic acid, and 10% to 25% phosphatidylethanolamine, wherein the percentages are by weight based on the total phospholipids. The fatty acid content may be 20% by weight to 30% by weight palmitic acid, 2% by weight to 10% by weight stearic acid, 15% by weight to 25% by weight oleic acid, and 40% by weight to 55% by weight linoleic acid.

Friction modifiers may include fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines.

In one embodiment the lubricating composition may contain phosphorus- or sulphur-containing antiwear agents other than compounds described as an extreme pressure agent of the amine salt of a phosphoric acid ester described above. Examples of the antiwear agent may include a non-ionic phosphorus compound (typically compounds having phosphorus atoms with an oxidation state of +3 or +5), a metal dialkyldithiophosphate (typically zinc dialkyldithiophosphates), a metal mono- or di-alkylphosphate (typically zinc phosphates), or mixtures thereof.

The non-ionic phosphorus compound includes a phosphite ester, a phosphate ester, or mixtures thereof.

In one embodiment the lubricating composition of the invention further includes a dispersant. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyether-amine dispersant.

In one embodiment the succinimide dispersant includes a polyisobutylene-substituted succinimide, wherein the polyisobutylene from which the dispersant is derived may have a number average molecular weight of 400 to 5000, or 950 to 1600. Succinimide dispersants and their methods of preparation are more fully described in U.S. Pat. Nos. 4,234,435 and 3,172,892.

Suitable ester-containing dispersants are typically high molecular weight esters. These materials are described in more detail in U.S. Pat. No. 3,381,022.

In one embodiment the dispersant includes a borated dispersant. Typically the borated dispersant includes a succinimide dispersant including a polyisobutylene succinimide, wherein the polyisobutylene from which the dispersant is derived may have a number average molecular weight of 400 to 5000. Borated dispersants are described in more detail above within the extreme pressure agent description.

Dispersant viscosity modifiers (often referred to as DVMs) include functionalised polyolefins, for example, ethylene-propylene copolymers that have been functionalized with the reaction product of maleic anhydride and an amine, a polymethacrylate functionalised with an amine, or esterified styrene-maleic anhydride copolymers reacted with an amine may also be used in the composition of the invention.

Corrosion inhibitors include 1-amino-2-propanol, octylamine octanoate, condensation products of dodecenyl succinic acid or anhydride and/or a fatty acid such as oleic acid with a polyamine.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors. Foam inhibitors include copolymers of ethyl acrylate and 2-ethylhexyl acrylate and optionally vinyl acetate.

Demulsifiers include trialkyl phosphates, and various polymers and copolymers of ethylene glycol, ethylene oxide, propylene oxide, or mixtures thereof.

Pour point depressants including esters of maleic anhydride-styrene, polymethacrylates, polyacrylates or polyacrylamides.

Seal swell agents including Exxon Necton-37™ (FN 1380) and Exxon Mineral Seal Oil™ (FN 3200).

Preferably the lubricating oil composition contains co-solvents selected from the group consisting of di-isodecyl adipate, di-propyladipate, di-isotridecyl adipate, trimethylpropyl tricaprylate, di-isooctyl adipate, di-ethylhexyl adipate and d-inonyl adipate. Preferably the lubricating oil composition contains co-solvents in an amount of ≥0.5% to ≤35% by weight, more preferably ≥1% to ≤30% by weight, related to the overall weight of the lubricating oil composition.

In another embodiment, the presently claimed invention is directed to a method of reducing friction in an engine using an engine oil comprising at least one alkoxylated polyethylene glycol as defined above or a mixture of polyethylene glycols as defined above.

In another embodiment, the presently claimed invention is directed to a method of enhancing the friction modification properties of a lubricating oil composition in the lubrication of a mechanical device comprising formulating said lubricating oil composition with at least one alkoxylated polyethylene glycol as defined above.

Enhancing the friction-modification properties means in the sense of the present invention that the friction coefficient of a lubricating oil composition comprising a carboxylic acid ester as defined above is lower that the friction coefficient of a lubricating oil composition that does not contain said carboxylic acid ester. The friction-modification properties are determined by measuring the friction coefficient at 25% slide roll ratio (SRR) using mini-traction machine (MTM) measurements at 70° C. and 1 GPa.

A mechanical device in the sense of the presently claimed invention is a mechanism consisting of a device that works on mechanical principles.

The mechanical device is preferably selected from the group consisting of bearings, gears, joints and guidances. Preferably the mechanical device is operated at temperatures in the range of ≥10° C. to ≤80° C.

EXAMPLES

OHZ=hydroxyl number, determined according to DIN 53240

Mn=number average molecular weight, determined according to DIN 55672-1 and referred to Polystyrene calibration standard.

Mw=weight average molecular weight, determined according to DIN 55672-1 and referred to Polystyrene calibration standard.

PD=polydispersity, determined according to DIN 55672-1

Measuring Physical Properties

The kinematic viscosity was measured according to the standard international method ASTM D 445.

The viscosity index was measured according to the ASTM D 2270.

The pour point according was measured to DIN ISO 3016.

Friction Coefficient Evaluation

The fluids were tested in the MTM (Mini-Traction Machine) instrument using the so-called traction test mode. In this mode, the friction coefficient is measured at a constant mean speed over a range of slide roll ratios (SRR) to give the traction curve. SRR=sliding speed/mean entrainment speed=2 (U1−U2)/(U1+U2) in which U1 and U2 are the ball and disc speeds respectively The disc and ball used for the experiments were made of steel (AISI 52100), with a hardness of 750 HV and Ra<0.02 μm. The diameter was 45.0 mm and 19.0 mm for the disc and the ball respectively. The tractions curves were run with 1.00 GPa contact pressure, 4 m/s mean speed and 70° C. temperature. The slide-roll ratio (SRR) was varied from 0 to 25% and the friction coefficient measured.

Oil Compatibility Evaluation

A method was developed in-house to determine oil compatibility. The oil and test material were mixed in 10/90, 50/50 and 90/10% w/w ratios respectively. The mixtures were mixed at room temperature by rolling for 12 hours. The mixtures' appearance was observed after homogenization and again after 24 hours. The test material is deemed compatible with the oil when no phase separation is observed after 24 hours for at least two of the ratios investigated.

Synthesis of the Polyalkylene Glycols

Example 1: Pluriol® E400 with 12 Equivalents of C12 Epoxide and 20 Equivalents of Butylene Oxide (Random)

A steel reactor (1.5 l) was loaded with polyethylene glycol 400 (MW 400) (0.2 mol, 80 g), and 3.23 g KOtBu (0.4 w %) was mixed and the reactor was purged with nitrogen. At a pressure of 2 bar a mixture of butylene oxide and C12 epoxide (4.0 mol, 288 g BuO; 2.4 mol, 441 g C12 epoxide) was brought in dropwise during 10 h at 140° C. and under pressure of 6 bar. The reactor was stirred for 10 h at 140° C. and cooled to 80° C. The product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 809 g, quantitative (Theor.: 809 g) OHZ: 33.6 mg KOH/g; (Theo.: 27.7 mg KOH/g); GPC: Mn: 3477; Mw: 3841;

Example 2: Pluriol® E200 with 12 Equivalents of C12 Epoxide and 20 Equivalents Butylene Oxide (Random)

A steel reactor (1.5 l) was loaded with polyethylene glycol 200 (MW 200) (0.2 mol, 80 g), and 3.07 g KOtBu (0.4 w %) was mixed and the reactor was purged with nitrogen. At a pressure of 2 bar a mixture of butylene oxide and C12 epoxide (4.0 mol, 288 g BuO; 2.4 mol, 441 g C12 epoxide) was brought in dropwise during 8 h at 140° C. and under pressure of 6 bar. The reactor was stirred for 10 h at 140° C. and cooled to 80° C. The product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 719 g, quantitative (Theor.: 769 g) OHZ: 32.0 mg KOH/g; (Theo.: 29.2 mg KOH/g); GPC: Mn: 3494; Mw: 3749;

Example 3: Pluriol® E1000 with 36 Equivalents of C12 Epoxide and 60 Equivalents Propylene Oxide (Random)

A steel reactor (1.5 l) was loaded with polyethylene glycol 1000 (MW 1000) (0.1 mol, 100 g), and 6.66 g CsOH 50% in water (0.3 w % to product) was mixed and the reactor was purged with nitrogen. At a pressure of 2 bar a mixture of propylene oxide and C12 epoxide (6.0 mol, 348 g PO; 3.6 mol, 662 g C12 epoxide) was brought in dropwise during 10 h at 140° C. and under pressure of 6 bar. The reactor was stirred for 10 h at 140° C. and cooled to 80° C. The product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 1125 g, quantitative (Theor.: 1110 g)

OHZ: 18.8 mg KOH/g; (Theo.: 10.1 mg KOH/g);

GPC: Mn: 5928; Mw: 7696;

Example 4: Pluriol® E400 with 12 Equivalents of C12 Epoxide and 10 Equivalents Propylene Oxide (Random)

A steel reactor (1.5 l) was loaded with polyethylene glycol 400 (MW 400) (0.25 mol, 100 g), and 1.6 g KOtBu (0.2 w %) was mixed and the reactor was purged with nitrogen. At a pressure of 2 bar a mixture of propylene oxide and C12 epoxide (2.5 mol, 145 g PO; 3.0 mol, 552 g C12 epoxide) was brought in dropwise during 8 h at 140° C. and under pressure of 6 bar. The reactor was stirred for 10 h at 140° C. and cooled to 80° C. The product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 773 g (Theor.: 802 g)

OHZ: 37.1 mg KOH/g; (Theo.: 35.2 mgKOH/g);

GPC: Mn: 3586; Mw: 3738; Mp: 3816.

Example 5: Pluriol® E400 with 12 Equivalents of C12 Epoxide

A steel reactor (1.5 l) was loaded with polyethylene glycol 400 (MW 400) (0.35 mol, 140 g), and 1.6 g KOtBu (0.2 w %) was mixed and the reactor was purged with nitrogen. At a pressure of 2 bar C12 epoxide (3.5 mol, 644 g) was brought in dropwise during 8 h at 140° C. and under pressure of 6 bar. The reactor was stirred for 10 h at 140° C. and cooled to 80° C. The product was stripped by nitrogen. Then the product was discharged and mixed with Ambosol® (magnesium silicate, 30 g) and mixed on a rotary evaporator at 80° C. The purified product was obtained by filtration in a pressure strainer (Filtrations media: Seitz 900). Yield: 748 g (Theor.: 784 g)

OHZ: 46.8 mg KOH/g; (Theo.: 50.1 mgKOH/g);

GPC: Mn: 2650; Mw: 2742; Mp: 2735.

The oil compatibility and friction data are summarized in Table 1. The data demonstrate that the molecules derived from the present invention, namely polyalkylene glycols produced from the alkoxylation of polyethylene glycol (PEG) with epoxydodecane show compatibility with mineral oils and low viscosity polyalphaolefins whilst providing low friction coefficients (≤0.023 at 25% SRR in MTM experiments).

TABLE 1

| | Kinematic viscosity ($mm^2/s$) | | Viscosity | Pour point | MTM friction coefficient at | Mineral oil Group III compatibility at room temperature (oil/test material) | | | Low viscosity PAO 6 compatibility at room temperature (oil/test material) | | |
|---|---|---|---|---|---|---|---|---|---|---|---|
| | 40° C. | 100° C. | Index | (° C.) | 25% SSR | 10/90 | 50/50 | 90/10 | 10/90 | 50/50 | 90/10 |
| Example 1 | 190 | 26.7 | 176 | −41 | 0.021 | Yes | Yes | Yes | Yes | Yes | No |
| Example 2 | 203 | 27.1 | 170 | −41 | 0.023 | Yes | Yes | Yes | Yes | Yes | Yes |
| Example 3 | 366 | 53.2 | 212 | −36 | 0.020 | Yes | Yes | Yes | Yes | Yes | Yes |
| Example 4 | 140 | 22.0 | 186 | −27 | 0.018 | Yes | Yes | Yes | Yes | Yes | Yes |
| Example 5 | 112 | 17.9 | 178 | −9 | 0.015 | Yes | Yes | Yes | Yes | Yes | Yes |

The invention claimed is:

1. A lubricant which comprises an alkoxylated polyethylene glycol of general formula (II)

(II)

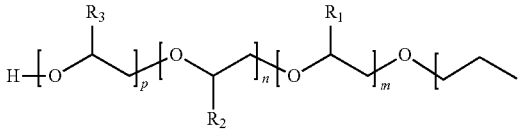

-continued

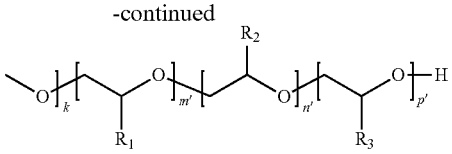

wherein m is an integer in the range of ≥1 to ≤30, m' is an integer in the range of ≥1 to ≤30, (m+m') is an integer in the range of ≥3 to ≤50, n is 0, n' is 0, p is an integer in the range of ≥0 to ≤90, p' is an integer in the range of ≥0 to ≤90, k is an integer in the range of ≥3 to ≤30, $R_1$ denotes an unsubstituted, linear alkyl radical having 10, 11, 12, 13, 14, 15, 16, 17 or 18 carbon atoms, $R_2$ denotes —$CH_2$—$CH_3$, and $R_3$ denotes —$CH_3$, and wherein the ratio of (m+m') to k is in the range of 1:1 to 3:1 and the ratio of (p+p') to k is in the range of 0.8:1 to 4:1, and whereby the concatenations denoted by k are distributed to form a block polymeric structure and the concatenations denoted by p, p', n, n', m and m' are distributed to form a block polymeric structure or a random polymeric structure.

2. A method of reducing friction in a lubricating oil composition comprising utilizing the lubricating oil composition comprising at least one lubricant wherein the lubricant comprises an alkoxylated polyethylene glycol of general formula (II)

(II)

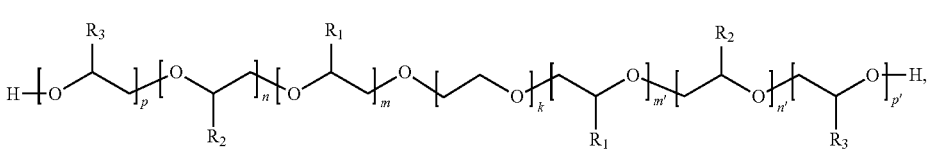

wherein m is an integer in the range of ≥1 to ≤50, m' is an integer in the range of ≥1 to ≤50, (m+m') is an integer in the range of ≥2 to ≤90, n is an integer in the range of ≥0 to ≤75, n' is an integer in the range of ≥0 to ≤75, p is an integer in the range of ≥0 to ≤90, p' is an integer in the range of ≥0 to ≤90, k is an integer in the range of ≥2 to ≤50, $R_1$ denotes an unsubstituted, linear or branched, alkyl radical having 6, 7, 8, 9, 10, 11, 12, 13, 14, 15, 16, 17, 18, 19, 20, 21, 22, 23, 24, 25, 26, 27 or 28 carbon atoms, $R_2$ denotes —$CH_2$—$CH_3$, and $R_3$ denotes —$CH_3$, and whereby the concatenations denoted by k are distributed to form a block polymeric structure and the concatenations denoted by p, p', n, n', m and m' are distributed to form a block polymeric structure or a random polymeric structure.

3. A lubricant which comprises an alkoxylated polyethylene glycol of general formula (II)

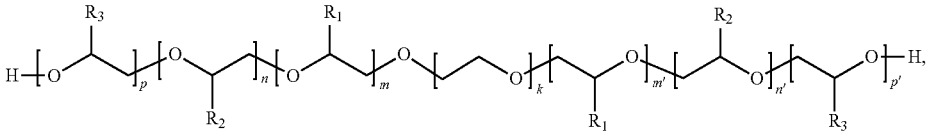

(II)

wherein m is an integer in the range of ≥1 to ≤30, m' is an integer in the range of ≥1 to ≤30, (m+m') is an integer in the range of ≥3 to ≤50, n is an integer in the range of ≥3 to ≤40, n' is an integer in the range of ≥3 to ≤40, (n+n') is an integer in the range of ≥6 to ≤40, p is an integer in the range of ≥0 to ≤75, p' is an integer in the range of ≥0 to ≤75, (p+p') is an integer in the range of ≥0 to ≤90, k is an integer in the range of ≥3 to ≤40, $R_1$ denotes an unsubstituted, linear alkyl radical having 6, 7, 8, 9, 10, 11, 12, 13, 14, 15, 16, 17 or 18 carbon atoms, $R_2$ denotes —$CH_2$—$CH_3$, and $R_3$ denotes —$CH_3$, and whereby the concatenations denoted by k are distributed to form a block polymeric structure and the concatenations denoted by p, p', n, n', m and m' are distributed to form a block polymeric structure or a random polymeric structure.

4. A lubricant which comprises an alkoxylated polyethylene glycol of general formula (II)

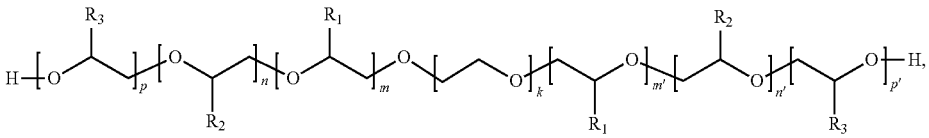

(II)

wherein m is an integer in the range of ≥1 to ≤25, m' is an integer in the range of ≥1 to ≤25, (m+m') is an integer in the range of ≥3 to ≤50, n is 0, n' is 0, p is an integer in the range of ≥3 to ≤45, p' is an integer in the range of ≥3 to ≤45, (p+p') is an integer in the range of ≥6 to ≤80, k is an integer in the range of ≥3 to ≤30, $R_1$ denotes an unsubstituted, linear alkyl radical having 6, 7, 8, 9, 10, 11, 12, 13, 14, 15, 16, 17 or 18 carbon atoms, $R_2$ denotes —$CH_2$—$CH_3$, and $R_3$ denotes —$CH_3$ and whereby the concatenations denoted by k are distributed to form a block polymeric structure and the concatenations denoted by p, p', n, n', m and m' are distributed to form a block polymeric structure or a random polymeric structure.

5. The lubricant according to claim 1, wherein the alkoxylated polyethylene glycol has a weight average molecular weight Mw in the range of 500 to 20,000 g/mol determined according to DIN 55672-1 (polystyrene calibration standard).

6. The lubricant according to claim 3, wherein n is an integer in the range of ≥3 to ≤25, n' is an integer in the range of ≥3 to ≤25, (n+n') is an integer in the range of ≥6 to ≤35, p is 0, p' is 0, k is an integer in the range of ≥3 to ≤30, and $R_1$ denotes an unsubstituted, linear alkyl radical having 9, 10, 11, 12, 13, 14, 15, 16, 17 or 18 carbon atoms.

7. The lubricant according to claim 6, wherein the ratio of (m+m') to k is in the range of 1:1 to 3:1 and the ratio of (n+n') to k is in the range of 1:1 to 6:1.

8. A lubricating oil composition comprising at least one lubricant as claimed in claim 1.

9. A method of enhancing the friction modification properties of a lubricating oil composition in the lubrication of a mechanical device comprising formulating said lubricating oil composition as claimed in claim 8 and lubricating the mechanical device.

10. The lubricant according to claim 3, wherein n is an integer in the range of ≥3 to ≤20, n' is an integer in the range of ≥3 to ≤20, (n+n') is an integer in the range of ≥6 to ≤30, and $R_1$ denotes an unsubstituted, linear alkyl radical having 9, 10 or 11 carbon atoms.

11. The lubricant according to claim 3, wherein n is an integer in the range of ≥3 to ≤20, n' is an integer in the range of ≥3 to ≤20, (n+n') is an integer in the range of ≥6 to ≤30, and wherein the ratio of (m+m') to k is in the range of 1:1 to 3:1 and the ratio of (n+n') to k is in the range of 1:1 to 6:1.

12. The lubricant according to claim 3, wherein n is an integer in the range of ≥3 to ≤20, n' is an integer in the range of ≥3 to ≤20, (n+n') is an integer in the range of ≥6 to ≤30, k is an integer in the range of ≥3 to ≤30, $R_1$ denotes an unsubstituted, linear alkyl radical having 9, 10 or 11 carbon atoms, and wherein the ratio of (m+m') to k is in the range of 1:1 to 3:1 and the ratio of (n+n') to k is in the range of 1:1 to 6:1.

13. The lubricant according to claim 3, wherein m is an integer in the range of ≥1 to ≤25, m' is an integer in the range of ≥1 to ≤25, (m+m') is an integer in the range of ≥3 to ≤40, n is an integer in the range of ≥6 to ≤15, n' is an integer in the range of ≥6 to ≤15,
(n+n') is an integer in the range of ≥12 to ≤25,
p is an integer in the range of ≥0 to ≤25,
p' is an integer in the range of ≥0 to ≤25,
(p+p') is an integer in the range of ≥0 to ≤70,
k is an integer in the range of ≥3 to ≤30,
$R_1$ denotes an unsubstituted, linear alkyl radical having 8, 9, 10, 11 or 12 carbon atoms,
wherein the ratio of (m+m') to k is in the range of 1:1 to 2:1 and the ratio of (n+n') to k is in the range of 1:1 to 6:1.

14. The lubricant according to claim 4, wherein
m is an integer in the range of ≥2 to ≤25,
m' is an integer in the range of ≥2 to ≤25,
(m+m') is an integer in the range of ≥4 to ≤40,
p is an integer in the range of ≥4 to ≤40,
p' is an integer in the range of ≥4 to ≤40,
(p+p') is an integer in the range of ≥8 to ≤70, and
$R_1$ denotes an unsubstituted, linear alkyl radical having 9, 10 or 11 carbon atoms.

15. The lubricant according to claim 4, wherein
the ratio of (m+m') to k is in the range of 1:1 to 2:1 and the ratio of (p+p') to k is in the range of 0.8:1 to 4:1.

16. The lubricant according to claim 4, wherein
p is an integer in the range of ≥3 to ≤40,
p' is an integer in the range of ≥3 to ≤40,
(p+p') is an integer in the range of ≥6 to ≤70,
$R_1$ denotes an unsubstituted, linear alkyl radical having 8, 9, 10, 11 or 12 carbon atoms, and
wherein the ratio of (m+m') to k is in the range of 1:1 to 2:1 and the ratio of (p+p') to k is in the range of 0.8:1 to 4:1.

17. The lubricant according to claim 4, wherein
p is an integer in the range of ≥3 to ≤40,
p' is an integer in the range of ≥3 to ≤40,
(p+p') is an integer in the range of ≥6 to ≤70,
$R_1$ denotes an unsubstituted, linear alkyl radical having 9, 10 or 11 carbon atoms,
wherein the ratio of (m+m') to k is in the range of 1:1 to 2:1 and the ratio of (p+p') to k is in the range of 0.8:1 to 4:1.

18. The lubricant according to claim 4, wherein
m is an integer in the range of ≥2 to ≤25,
m' is an integer in the range of ≥2 to ≤25,
(m+m') is an integer in the range of ≥4 to ≤40,
p is an integer in the range of ≥4 to ≤40,
p' is an integer in the range of ≥4 to ≤40,
(p+p') is an integer in the range of ≥8 to ≤70,
$R_1$ denotes an unsubstituted, linear alkyl radical having 9, 10 or 11 carbon atoms, and
wherein the ratio of (m+m') to k is in the range of 1:1 to 2:1 and the ratio of (p+p') to k is in the range of 0.8:1 to 4:1.

19. The lubricant according to claim 3, wherein wherein
m is an integer in the range of ≥2 to ≤25,
m' is an integer in the range of ≥2 to ≤25,
(m+m') is an integer in the range of ≥4 to ≤40,
n is an integer in the range of ≥3 to ≤20,
n' is an integer in the range of ≥3 to ≤20,
(n+n') is an integer in the range of ≥6 to ≤30,
p is 0,
p' is 0,
k is an integer in the range of ≥3 to ≤30,
$R_1$ denotes an unsubstituted, linear alkyl radical having 9, 10 or 11 carbon atoms, and
wherein the ratio of (m+m') to k is in the range of 1:1 to 2:1 and the ratio of (n+n') to k is in the range of 2:1 to 6:1.

20. The lubricant according to claim 3, wherein the alkoxylated polyethylene glycol has a weight average molecular weight Mw in the range of 500 to 20,000 g/mol determined according to DIN 55672-1 (polystyrene calibration standard).

21. The lubricant according to claim 4, wherein the alkoxylated polyethylene glycol has a weight average molecular weight Mw in the range of 500 to 20,000 g/mol determined according to DIN 55672-1 (polystyrene calibration standard).

22. The lubricant according to claim 19, wherein the alkoxylated polyethylene glycol has a weight average molecular weight Mw in the range of 500 to 20,000 g/mol determined according to DIN 55672-1 (polystyrene calibration standard).

23. A lubricating oil composition comprising at least one lubricant as claimed in claim 3.

24. A lubricating oil composition comprising at least one lubricant as claimed in claim 4.

25. A lubricating oil composition comprising at least one lubricant as claimed in claim 19.

26. A method of reducing friction in a lubricating oil composition comprising utilizing the lubricating oil composition according to claim 1.

27. A method of reducing friction in a lubricating oil composition comprising utilizing the lubricating oil composition according to claim 3.

28. A method of reducing friction in a lubricating oil composition comprising utilizing the lubricating oil composition according to claim 4.

* * * * *